US009303394B2

(12) United States Patent
Mock et al.

(10) Patent No.: US 9,303,394 B2
(45) **Date of Patent: *Apr. 5, 2016**

(54) WASHING DEVICE

(71) Applicant: CREAHOLIC S.A., Biel (CH)

(72) Inventors: Elmar Mock, Colombier (CH); Andre Klopfenstein, La Neuveville (CH); Laurent Torriani, Lamboing (CH)

(73) Assignee: CREAHOLIC S.A., Biel (CH)

( * ) Notice: Subject to any disclaimer, the term of this patent is extended or adjusted under 35 U.S.C. 154(b) by 91 days.

This patent is subject to a terminal disclaimer.

(21) Appl. No.: 13/897,905

(22) Filed: May 20, 2013

(65) Prior Publication Data

US 2013/0247295 A1 Sep. 26, 2013

Related U.S. Application Data

(62) Division of application No. 12/095,210, filed as application No. PCT/CH2006/000660 on Nov. 27, 2006, now Pat. No. 8,458,826.

(30) Foreign Application Priority Data

Nov. 29, 2005 (CH) ..... 1890/05

(51) Int. Cl.
*A47K 3/00* (2006.01)
*A47K 1/00* (2006.01)
(Continued)

(52) U.S. Cl.
CPC ... *E03C 1/18* (2013.01); *B05B 1/26* (2013.01); *B05B 1/262* (2013.01); *B05B 3/001* (2013.01); *B05B 3/02* (2013.01); *E03C 1/041* (2013.01); *E03C 1/0404* (2013.01); *E03C 1/046* (2013.01)

(58) Field of Classification Search
CPC ..... B05B 7/2448; B05B 1/26; B05B 1/262; B05B 3/001; B05B 3/02; E03C 1/0404; E03C 1/041; E03C 1/046
USPC ..... 4/626; 239/314
See application file for complete search history.

(56) References Cited

U.S. PATENT DOCUMENTS 3,088,017 A 4/1963 Schomann
3,872,879 A 3/1975 Green
(Continued)

FOREIGN PATENT DOCUMENTS

BE 514104 9/1952
CA 2437426 2/2005
(Continued)

OTHER PUBLICATIONS

"The HEATSTORE Aqua-Flow Pumped Electric Shower Handbook"; Heatstore Limited; Island Park, Bristow Broadway, Bristol, Great Britain; www.heatstore.co.uk.

*Primary Examiner* — Huyen Le
*Assistant Examiner* — Christine Skubinna
(74) *Attorney, Agent, or Firm* — Rankin, Hill & Clark LLP

(57) ABSTRACT

A washing device for dispensing water in the sanitary field, in particular in a shower or a sink, including an outlet for spraying fluids with a lower throughput rate, as well as a delivery device for increasing the fluid pressure before the spraying. The washing device includes a heating device for heating the water. Atomization is accomplished by way of a fluid jet hitting an obstacle with a high relative speed. Thereby, the obstacle may be a moved or stationary solid body or at least one further fluid jet. Spraying is accomplished by way of the outlet including at least one nozzle set with at least two nozzles, for producing impacting fluid jets and for atomizing the fluid.

16 Claims, 7 Drawing Sheets

(51) Int. Cl.

| | |
|---|---|
| ***E03C 1/18*** | (2006.01) |
| ***B05B 1/26*** | (2006.01) |
| ***B05B 3/02*** | (2006.01) |
| ***E03C 1/04*** | (2006.01) |
| ***E03C 1/046*** | (2006.01) |
| ***B05B 3/00*** | (2006.01) |

(56) References Cited

U.S. PATENT DOCUMENTS

| | | | | | |
|---|---|---|---|---|---|
| 3,965,494 | A | | 6/1976 | Baker | |
| 4,187,986 | A | | 2/1980 | Petrovic | |
| 4,262,372 | A | | 4/1981 | Ryder | |
| 4,287,618 | A | | 9/1981 | Silver | |
| 4,348,432 | A | | 9/1982 | Huang | |
| 4,393,525 | A | | 7/1983 | Kondo | |
| 4,419,775 | A | | 12/1983 | Ebert | |
| 4,563,780 | A | | 1/1986 | Pollack | |
| 4,602,391 | A | | 7/1986 | Shepherd | |
| 4,761,837 | A | | 8/1988 | Takeda | |
| 4,785,845 | A | | 11/1988 | Kochal | |
| 4,955,539 | A | | 9/1990 | Ruttenberg | |
| 5,050,799 | A | * | 9/1991 | Rohs | F02M 61/02 239/124 |
| 5,125,577 | A | | 6/1992 | Frankel | |
| 5,246,167 | A | | 9/1993 | Mahon | |
| 5,253,811 | A | | 10/1993 | Sieth | |
| 5,826,282 | A | | 10/1998 | Matsumoto et al. | |
| 5,992,298 | A | | 11/1999 | Illy et al. | |
| 6,192,192 | B1 | | 2/2001 | Illy et al. | |
| 2001/0048811 | A1 | | 12/2001 | Waithe et al. | |
| 2003/0026712 | A1 | | 2/2003 | Beckerman | |
| 2004/0039354 | A1 | | 2/2004 | Lutz, II | |
| 2006/0027673 | A1 | | 2/2006 | Fabrizio | |

FOREIGN PATENT DOCUMENTS

| | | | | | |
|---|---|---|---|---|---|
| CN | 2049103 | | | 12/1989 | |
| CN | 1686037 | | | 10/2005 | |
| DE | 4023366 | | | 1/1992 | |
| DE | 4204308 | | | 8/1993 | |
| DE | 9313412 | | | 12/1993 | |
| DE | 4236037 | | | 4/1994 | |
| DE | 10004534 | | | 8/2001 | |
| EP | 0832400 | | | 3/1999 | |
| EP | 0869731 | | | 3/2000 | |
| EP | 1121985 | | | 8/2001 | |
| GB | 797273 | | | 7/1958 | |
| GB | 1399490 | | | 7/1975 | |
| GB | 2002262 | | | 2/1979 | |
| GB | 2309181 | | | 7/1997 | |
| JP | 34-016972 | | * | 10/1934 | |
| JP | 34-16972 | | | 10/1934 | |
| JP | 49-143005 | | | 12/1974 | |
| JP | 2-91654 | | | 7/1990 | |
| JP | 3-122163 | | | 12/1991 | |
| JP | 04037070 | | | 3/1992 | |
| JP | 05-176856 | | | 7/1993 | |
| JP | 5220426 | | | 8/1993 | |
| JP | 6154662 | | | 6/1994 | |
| JP | 7259163 | | | 10/1995 | |
| JP | 8289853 | | | 11/1996 | |
| JP | 8289853 | A | * | 11/1996 | |
| JP | 10043642 | | | 2/1998 | |
| JP | 2000-045365 | | | 2/2000 | |
| JP | EP 1031518 | A1 | * | 8/2000 | B65D 83/20 |
| JP | 2004-033821 | | | 2/2004 | |
| WO | 97/24969 | | | 7/1997 | |
| WO | 98/04322 | | | 2/1998 | |
| WO | 98/07522 | | | 2/1998 | |
| WO | 99/25489 | | | 5/1999 | |
| WO | 00/11997 | | | 3/2000 | |
| WO | 2004/040071 | | | 5/2004 | |
| WO | 2004/101163 | | | 11/2004 | |
| WO | 2005/057086 | | | 6/2005 | |

* cited by examiner

WASHING DEVICE

BACKGROUND OF THE INVENTION

The invention relates to the field of spraying apparatus, in particular to a washing device and a method for operating a washing device according to the preamble of the respective independent patent claims.

DESCRIPTION OF RELATED ART

Such a washing device is known, for example, from WO 2004/101163 A1. A shower head is described therein, in which water nozzles are arranged in pairs, so that the jets from two nozzles of a pair impact one another and create droplets by way of this. The purpose of the device is to provide a pleasant shower experience at different operating pressures between 0.2 bar and 10 bar, and also to reduce the water consumption compared to conventional shower heads. Thereby, apart from the water droplets, one should, however, prevent a mist of very fine droplets from occurring. For this, the jets impacting one another are preferably arranged such that they do not fully intersect one another.

Furthermore, it is known, for example, from WO 98/07522, to install a heater in a shower sprinkler, in order to heat water directly before dispensing through the shower sprinkler. Thereby however, a large amount of heating power is required in accordance with the quantity of water flowing through.

An electrical shower is described in the product handbook "The Heatstore Aqua-Flow. Pumped Electric Shower Handbook" of the company Heatstore Limited, Island Park, Bristow Broadways, Bristol BS11 9FB, downloaded from vwww.heatstore.co.uk on Nov. 7, 2006. The shower is provided in order to be fed from a cistern, and thus, comprises a pump for delivering the water. A two-stage electrical heater is provided for heating the water, whose heating power is 8.5 kW/7.8 kW or 9.5 kW/8.7 kW, depending on the model. The temperature of the dispensed water is set by way of varying the water throughput quantity. A hand-operated control valve is arranged downstream of the pump for this. The entry pressure in front of the apparatus may not be too high, probably for the protection of the pump, which is why the apparatus may not be connected to water supply mains, and may not be arranged more than 10 m below the cistern. The heating power as well as the throughput quantity, is thus relatively high.

DE 100 04 534 A1 describes a hydro-massage nozzle for producing a pulsating water jet. For this, the massage nozzle is suitably activated by pumps or valves. The massage nozzle is provided for operation in a pool such as a shower bath, jacuzzi, swimming pool or exercise pool, thus for operation below water, so that no atomisation takes place.

BE 514 104 shows a spray head with atomisation by way of jets impacting one another. A spray core comprises four or more oblique bores with a diameter of 1 mm to 12 mm, which are directed onto a common focal point. A sieve acts as a dirt filter. A pressure increase by a pump for example, is not, however, mentioned.

BRIEF SUMMARY OF THE INVENTION

It is therefore the object of the invention to provide a washing device and a method for the operation of a washing device, or for the preparation of water for washing, of the initially mentioned type, which permits a reduction of the consumption of energy and/or water compared to the state of the art.

A further object of the invention is to provide a washing device which may be installed with little effort and in particular may also be installed into buildings or installations with existing water mains and electrical mains, without significant modification of the mains.

A further object is to provide a washing device and a method for the operation of a washing device, which is not susceptible with regard to the spreading of infectious diseases.

These objects are achieved by a washing device and a method for operating a washing device with the features of the respective independent patent claims.

The washing device for dispensing water or a mixture based on water, in particular in the sanitary field, for example in a shower or a sink, includes at least one outlet for spraying fluids with a low flow rate and under a high pressure, as well as at least one delivery device for increasing the fluid pressure to an operating pressure of the outlet, before spraying.

If the washing device is connected to a water main, then the operating pressure of the outlet lies above the nominal pressure of the water mains. This nominal pressure is typically about 2.5 bar, and the pressure in the house installations (depending on the regulations of the local water main company) is typically limited to 5 bar or 6 bar for the protection of the conduits.

The spraying of the fluid is effected naturally in a gaseous medium, and with a washing device, typically in the atmosphere or the surrounding air, in which the washing device is operated.

The sprayed fluid as a rule is water or a water-based mixture. An addition such as soap or another cleaning agent or disinfectant may be admixed to the water. The mixture may come from all nozzles. It is also possible to supply the different nozzles with different fluids or fluid mixtures, for example one nozzle with water and another with fluid soap, or one with water and another with disinfectant. In further embodiments of the invention, gaseous fluids may be fed through individual nozzles. A gas jet under high pressure may also be used for atomising a fluid jet. The gas jet may, in particular, be a steam jet.

The washing device, apart from the sanitary field, may also be applied in the therapeutic, field, the cosmetic field as well as the pharmacy field. The admixed fluids thereby may also contain cosmetic or medical active ingredients.

With the application in other fields, additives such as nutrients, fertilisers, pesticides etc. may also be admixed, wherein a good atomisation and, thus, an increase in the total surface of the fluid to be atomised takes place. Basically, fluids other than those based on water maybe sprayed with similar types of means, for example fuels in drives or heaters, or chemicals in processing chemistry. Industrial applications of the atomisation methods and atomisation devices for coating and impregnating are likewise possible.

By way of the pressure increase, it is possible, despite a small throughput rate, to spray the fluid such that a pleasant washing experience or shower experience arises. In particular, in trials, it has been found that the skin is completely moistened, even with unexpectedly low throughput rates, and there is no sensation that too little water is dispensed. This perception is due to the fact that the particle size of the water droplets is significantly reduced compared to conventional showers, on account of the spraying or atomisation with an increased pressure and accordingly by way of narrow nozzles. By way of this, the whole surface of the fluid droplet is significantly larger than with the same fluid quantity with larger drops, and the effect on wetting the body is accordingly also increased. For example, given the same volume, drops of 50 micrometers radius have a 20 times greater contact surfaces than a drop of 1 mm radius.

This delivery device or pump, as a part of the washing device, is thus arranged in a preferably local manner, in the vicinity of the outlet or a shower head, thus in a bathroom or as an installation element of a mobile or stationary shower cubicle. Basically, a central pressure increase, for example in a building for several installations, is also conceivable. Such a central pressure increase may be provided for whole buildings, or several units may be applied for the central pressure increase, for example, in each case one unit for one storey, or in each case one unit for a vertical supply line through several storeys. Thus, the pump noises may be kept away from the users in an improved manner. However, existing conduits in buildings as a rule are overburdened with the preferably applied operating pressures of the outlet of 10 to 40 or 50 bar, in particular 15 to 25 bar, and new pressure conduits for water would have to be applied for this. The pump for example is electrically operated.

Vice versa, with the application of de-centralised pumps, one may also apply several pumps per washing device, in particular if different fluids are mixed in the washing device. Thus one may provide an individual pump for each of the fluids, and the quantity of this fluid may be controlled by way of activation of the respective pump. Thereby, the mixture of the fluids is either effected before the spraying or during the spraying itself. In order for a clean spraying to take place in the second case, the pumps may, for example, be activated in a coordinated manner, or at least one pair of nozzles directed counter to one another and which are fed by the same pump may be present for each of the fluids. Thus, a clean atomisation takes place for each of the fluids, independently of the exact delivery quantity and jet speed of the other fluid. The impact points of the several nozzle pairs (corresponding to the several fluids) may coincide, or may for example be distanced to one another in the main spraying direction.

A control of the throughput quantity may be effected by way of control of the pump(s) or by way of mechanical control means at the outlet or in the feed conduit. Such a mechanical control means is e.g. a manually adjustable reduction valve.

The washing device is particularly suitable for the installation in transport means such as trains, aircraft, campers or other mobile set-ups, such as travelling washing installations, etc. on account of the low water consumption. Other applications are, for example, in showers or washing installations, in public swimming baths, in dish washers or for the irrigation of plants.

In a further embodiment of the invention, the pump or a means for pressure production is operated in a manual manner. Thus firstly, pressure may be produced in a pressure storage means without external energy supply, and a washing device may be used subsequently or over a longer period of time. This embodiment of the invention is particularly advantageous when it is combined with the solar production of warm water. With this, one obtains a completely autonomous washing unit with low water consumption. Preferably thereby, the pressure storage means is identical with a water storage means, and furthermore comprises a surface which may be exposed to radiation, for heating the water storage means. The pressure, thereby, may be stored by way of expansion of a flexible vessel and/or by way of compression of an air volume in the pressure storage means.

In one preferred embodiment of the invention, the washing device includes a heating device for heating the water or the fluid. This heater may be designed in a comparatively small manner thanks to the low throughput rate. In particular, it may be designed as a tankless water heater, thus without any storage means in which the water is heated, as is the case with boiler heating or thermal storage heating. The heater may be operated electrically, with a fluid fuel such as gas or oil, or also in a different manner.

In another embodiment of the invention, the supply with warm water is effected from a boiler, thus from a storage heating installation or generally with stored warm water.

An electrical heater may be operated with existing electrical house installations on account of the low required heating power. The heating may be arranged in a decentralised manner by way of this, i.e. each shower or washing device has its own heater, and no central warm water provision is required. Various advantages result from this, in particular for installations in hotels:

- One requires only a single cold water supply for the washing device, and one may make do without a warm water supply.
- The storage losses and the conduit losses of a conventional central warm water provision are eliminated, on account of the de-centralised heating which is only effected on demand.
- No cultures of infectious diseases such as legionnaire's disease may arise since the system only contains cold water until shortly before use.

The heating device is preferably set up for heating the water with closed-loop control shortly before dispensing at a predefined dispensing temperature. With this, one may set a temperature by way of a manually adjustable setting device, e.g. by way of a dial. The water temperature is measured and is automatically controlled with a closed loop by way of adapting the heating power. This is significantly more accurate, quicker and more comfortable than the conventional closed-loop control of the temperature by way of setting a mixing ratio at a mixing tap. Preferably thereby, the manually adjustable rated temperature of the closed-loop temperature control is limited to a predefined value and/or the dispensing temperature is limited to a predefined value. Such a value for washing devices for persons is for example 45° C. or 50° C. or 55° C. With this, on the one hand one prevents scalding, and on the other hand the heating power may be kept low or limited in accordance with the maximal throughput quantity.

In another preferred embodiment of the invention, unheated water is admixed to the heated water after the heating, in order to reduce the water temperature. With this, the heating may be operated at a different (more efficient) operating point, than if the heating were to reach the lowered temperature without admixture. For example, the heater may heat the water to about 90° C., whereupon (for sanitary applications) it may be brought to a lower dispensing temperature by way of admixing cold water. One may also use a higher dispensing temperature for other applications.

Amongst other things, tankless water heaters, as are disclosed in EP 0 832 400 B1, or in EP 0 869 731 B1 are suitable for the heating. These documents are adopted into the application by way of reference. Accordingly, a heated tube is suspended such that it is movable or deformable on operation. The cause for the movement or deformation may be temperature changes, pressure changes and/or vibrations of a pump. Furring in the tube may be detached by way of this. These tankless water heaters were originally conceived for coffee machines and thus—compared to conventional washing devices and shower devices—for relatively low throughput quantities. They may be combined with spraying devices with a low throughput according to the present invention, possibly whilst adapting the heating power. These tankless water heaters are, in particular, suitable for high operating pressures, in particular up to 10 bar or more. The closed loop control of the temperature may also be effected by way of a closed-loop control of the electrical heating power or by way of admixing cold water.

The washing device, thus, preferably comprises a supply with cold water and a supply with energy for the heating, but no supply with warm water. The energy supply may be an electrical one or a supply with a combustible gas. Another supply, however, may not be ruled out.

The washing installation may thus be designed as a compact construction unit with only one cold water connection and one electrical supply connection. Such a construction unit, in a housing contains the pressure pump and the heater as well as preferably a pre-treatment unit for the fed water, or fluid. The pre-treatment unit preferably comprises one or a combination of the following functions: coarse filter, microfilter, disinfection, antibacterial treatment, deliming. Operating elements for the control of the temperature and/or pressure may be present as control inputs. These may be attached to the construction unit itself or on a relocated operating unit.

In a preferred embodiment of the invention, the maximal throughput quantity of the outlet is 5 l/min or 3 l/min, and preferably 1.0 to 1.5 to 2 l/min, which corresponds to a heating device with a maximal heating power of about 3 kW.

In a preferred embodiment of the invention, the maximal throughput quantity of the outlet is 1 l/min and preferably 0.5 l/min, which corresponds to a heating device with a maximal heating power of about 1 kW. These conditions are suitable, for example, for an outlet in a water tap for a wash basin (or rinse basin or sink).

The throughput quantities mentioned above, in each case relate to one nozzle set. The throughput is accordingly increased when applying several nozzle sets. The heating power for an electrical heater is typically limited to 2, 4 or 6 kW depending on the fuse protection and the number of applied phases. The maximal throughput quantity with a decentralised heating is limited by way of this, which represents an important incentive to reduce the throughput quantity whilst simultaneously maintaining the washing quality.

In a further preferred embodiment of the invention, the washing device comprises a mixing device for mixing the water with soap before dispensing. This mixing device may be switched on and off, so that the washing installation may be operated in a first operating mode and second operating mode, wherein soap is admixed to the water and the water throughput for example is less than 3 l/min or less than 1 l/min and is preferably 0.5 l/min, in the first operating mode ("lathering"), and no soap is admixed to the water and the water throughput is up to 1 l/min or (with a shower) up to 3 l/min or up to 5 l/min in the second operating mode ("rinsing").

In a preferred embodiment of the invention, the outlet comprises a nozzle body, said nozzle body comprising two nozzle disks, wherein the nozzle disks are arranged, rotatable to one another in different positions. Thereby, one set of nozzles of the first nozzle disk is connected to different sets of nozzles of the second nozzle disk, depending on the angle of rotation. If the first nozzle disk is an upper nozzle disk, i.e. the nozzle disk which is impinged by pressurised water, and the second nozzle disk is a lower one which faces the consumer or the spray direction, then one nozzle set with selectable characteristics may be coupled to the feeding nozzle set of the upper nozzle disk by way of rotating the second nozzle disk.

In the case that the first nozzle disk is a lower nozzle disk, then one of different feeding nozzle sets of the second upper nozzle disk may be selected by way of rotating the first nozzle disk. Different feeding nozzle sets may for example be fed with different fluids or fluid combinations, so that a selection of the mixture of the sprayed fluid is possible by way of rotating the first nozzle disk.

In a preferred embodiment of the invention, the atomisation is accomplished by way of a fluid jet impinging an obstacle with a high relative speed. Thereby, the obstacle may be a moved or stationary solid body or at least one further jet of a fluid, thus a liquid jet or a gas jet. The relative speed arises on account of the speed of the fluid jet and/or a movement of the solid body. Means for achieving a high relative speed are therefore nozzles for producing a fluid jet, under certain circumstances, in combination with a pump for pressure increase, and/or moved solid bodies, onto which one or more fluid jets impinge. In particular, such a solid body, hereinafter also called atomisation body, may rotate with a high speed of revolution. The revolution speed is directed to the desired relative speed and the radius of an impact point of a fluid jet, with respect to the rotation axis.

The relative speed between the particles in the fluid jet and the atomisation body is above 20, 30 or 40 m/s and preferably at least approximately 50 m/s. A suitable size and speed of the atomised jet is achieved with this.

In a preferred embodiment of the invention, the atomisation is accomplished by way of the outlet comprising at least one nozzle set with at least two nozzles for producing fluid jets impacting one another and for atomising the fluid. The nozzle set, for example, comprises two, three, four or more nozzles, whose jets at least approximately hit one another in one point. In a further variant, the jets may be deliberately displaced slightly, so that they do not impact in a point, in order for example to effect a massage sensation.

If the fluid, apart from water, comprises a further medium such as soap, then this further medium may be admixed to the supply of all nozzles or however only individual nozzles. For this, the washing device comprises a mixing device for admixing soap into the fluid supply of at least one of the nozzles.

With an adequately low viscosity, the further medium may alternatively be fed as a liquid to at least one nozzle in an unmixed manner. In both cases, the liquids are additionally mixed and distributed on colliding. Basically, it is also possible when supplying the nozzles with different fluids, to thereby vary the supply pressure, the type of the several applied pumps and the nozzle diameter of the nozzles amongst one another, according to the respective liquids. An optimal, balanced atomisation may be achieved with this. For example, soap may be led from above to the impact point of the colliding jets and thus be admixed.

In a preferred embodiment of the invention, the washing device comprises protective bodies which are arranged in the direction of the nozzles, so that a liquid jet which is not hit by other fluid jets impinges a protective body. With this, given a blockage of a nozzle, one prevents the jet from another nozzle of the nozzle set from directly hitting the skin or eyes.

However, it has been found that should there be no perfect alignment of the jets of a nozzle set, these partly atomise and the remaining part causes a "prickling" effect on the skin, which, depending on the intensity and personal preference, may be perceived as being pleasant or as massaging. For this reason, in a preferred embodiment of the invention, the nozzles are not aligned to one another in an exact manner, but for example, one with an intersection (overlapping) of the jet surfaces of 60% or 80%. One may, however, also switch over between operating modes with a different intersection and, thus, a different shower sensation. This may be effected by way of switching over between several nozzle sets, or by way of mechanical variation of the alignment of at least one nozzle of a nozzle set.

An asymmetry of the atomised water jet arises by way of the only partial intersection of the jet surfaces. Other possibilities for producing an asymmetry are, for example, the application of different nozzle diameters with at least two nozzles of a nozzle set. However, two nozzles of a nozzle set may also be operated with different fluid pressures. This may be achieved by way of using separate pumps per nozzle or by way of using different pressure reduction means (throttles) per nozzle. Basically, it is also possible to vary and control different pressures per nozzle also over time. The shape and thus also a movement of the atomised jet may be dynamically varied with this.

In a preferred embodiment of the invention, the outlet comprises exactly one nozzle set. The outlet may be manufactured in a very compact and simple manner by way of this.

Preferably, a diameter of the nozzles 3 is between 0.1 or 0.2 or 0.3 mm and 1.3 mm to 2 mm, in particular between 0.4 mm and 0.7 mm. The length of the nozzles for achieving a laminar flow in the jet, is at least double the diameter. Preferably thereby, a pressure of 10 bar to 50 bar, in particular of 15 bar to 25 bar is used as the operating pressure of the outlet, wherein the pressure is preferably essentially constant, thus is not pulsating. Half the impact angle, relative to the vertical, preferably lies between 35 and 55 degrees, in particular at 45 degrees. It may, however, basically be between zero and almost 90 degrees.

In a preferred embodiment of the invention, the pressure may be set by a user. Thereby, either the pressure is set in a controlled manner according to the sensation of the user, or a nominal value is set by the user, to which one controls with a closed loop by way of pressure measurement and by way of a pressure regulation.

In further preferred embodiments of the invention, the outlet has at least one nozzle for producing a water jet or fluid jet, as well as a movable or fixedly arranged atomisation body for atomising this jet. The jet is, thus, directed onto the atomisation body. A fixedly arranged atomisation body is attached on the outlet in a fixed manner and is not movable with respect to the jet or the jets.

In a preferred embodiment of the invention, the atomisation body may be moved along a line with respect to the at least one nozzle. A change of the atomisation characteristics or of the geometry of the droplet cloud produced on atomising is achieved by way of this.

Preferably, the nozzle is directed along the mentioned line in each case onto a different region of the atomisation body, in accordance with the position of the atomisation body. Thereby, the regions have different characteristics, in particular a different orientation with respect to the jet and/or a different surface structure.

In a further preferred embodiment of the invention, the atomisation body may be rotated about a rotation axis with respect to the at least one nozzle. Different functions may be achieved by way of this. On the one hand, a differently fashioned region of the atomisation body may be rotated into the jet or the jets by way of a temporary rotation about the rotation axis, similarly as with the linear displacement, so that the atomisation characteristics are changed. On the other hand, one may achieve an atomisation without the fluid jet from the at least one nozzle having a particularly high pressure or a high energy, by way of a permanent rotation with a high rotation speed. This embodiment may, also, therefore be realised without a pressure increase or pump.

Preferably, the atomisation body is at least approximately an ellipsoid of revolution, in particular a sphere, or at least approximately a disk, wherein the at least one nozzle is directed onto a disk surface or onto a disk edge. The atomisation body may also have a prismatic shape with an arbitrary cross section.

The method for operation of a washing installation for dispensing water or a water-based mixture, and optionally a further liquid, preferably in the sanitary field, in particular in a shower or a sink, comprises the following steps:

- increasing the water pressure or the fluid pressure to an operating pressure of an outlet; and
- spraying the water or the fluid at a high pressure and low throughput rate through the outlet.

Further preferred embodiments are to be deduced from the dependent patent claims. Thereby, the features of the method claims may be combined, analogously, with the device claims and vice versa.

BRIEF DESCRIPTION OF THE DRAWINGS

The subject matter of the invention is hereinafter explained in more detail by way of the preferred drawings. In each case there are shown schematically in.

The reference numerals used in the drawings and their significance are listed in a conclusive manner in the list of reference numerals. Basically, the same parts are provided with the same reference numerals in the figures.

DETAILED DESCRIPTION OF THE INVENTION

Figure 1:
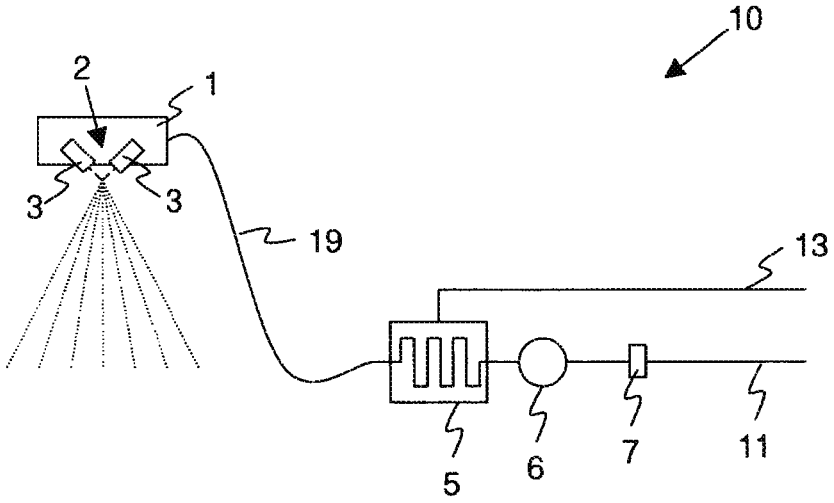
FIG. 1 a first embodiment of a washing device.

FIG. 1 shows a first embodiment of a washing device 10. This comprises an outlet 1 with at least one nozzle set 2. The nozzle set 2, in turn, comprises two or more nozzles 3. Fluid at a high pressure and thus a high speed or energy is dispensed in a directed manner with the nozzles 3 on operation. The nozzles 3 of a nozzle set 2 are directed such that the dispensed fluid jets intersect one another and preferably meet at one point. The fluid is atomised by way of this, and thus creates a high moistening/wetting effect. The fluid as a rule is water, wherein however another fluid or a mixture of water with a further substance such as soap, disinfectant etc. may be dispensed at one, several, or all nozzles.

The fluid is led to the outlet 1 preferably via a hose 19 or generally via an outlet conduit which is designed with regard to the operating pressure of the outlet, thus may withstand this operating pressure. The outlet conduit may be assembled in a fixed manner. The outlet may be a shower sprinkler assembled in a fixed manner or a shower sprinkler which is movable and is held by hand, or a shower head. The liquid is heated by the heater 5 having an energy supply 13, and is delivered by a pump 6 and brought to an increased operating pressure. In another embodiment of the invention, the heater 5 is arranged in front of the pump 6 in the flow direction, so that therefore the pump 6 is designed for delivering the already heated water. Preferably a micro-filter 7 is arranged at the feed of the fluid 11 or is arranged at another location of the fluid path, in order to prevent the nozzles 3 from becoming blocked. In the shown embodiment of the invention, the supply of the fluid is a cold water supply 11.

The filter 7 is preferably provided for filtering particles with a size of more than 100, in particular over 50 micrometers, from the water or the liquid.

Figure 2:
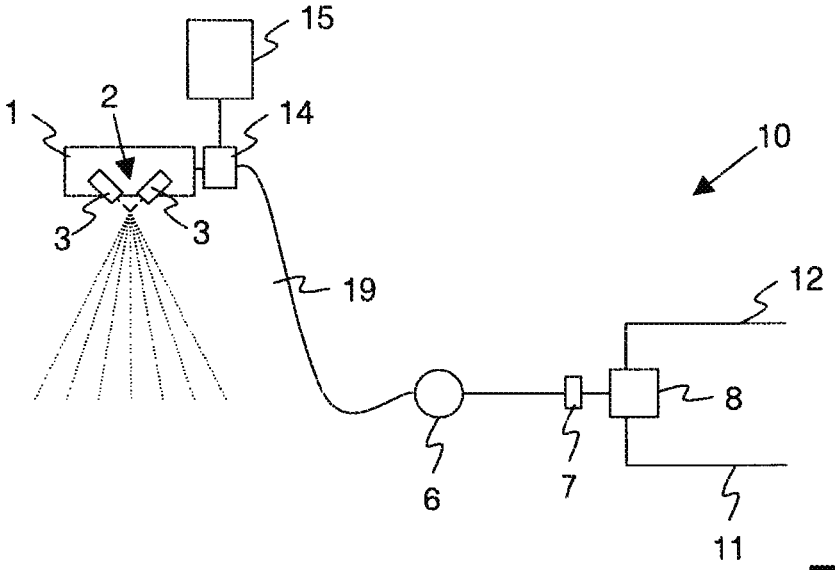
FIG. 2 a further embodiment.

FIG. 2 shows a further embodiment which has no heating 5 but instead of this is supplied via a mixing tap 8, with which water from a cold water supply 11 and a warm water supply 12 are mixed to the desired temperature.

A soap feed 15 is drawn in as a further embodiment of the invention, via which soap may be admixed to the water by way of a mixing device 14. Instead of soap, also other fluid or powder-like additives may be admixed in this manner. The mixing device 14 may usefully be switched on and off, so that one may switch between one operating mode "lathering" with soap, and an operating mode "rinsing" without soap. In this case, the mixing device 14 must be arranged extremely close to the shower head, so that only water leaves to shower head as soon as possible after switching of the mixing device 14. Preferably, the delivered water quantity per unit of time, thus the throughput is increased with the operating mode "rinsing" compared to the operating mode "lathering", for example by way of switching over between different nozzle sets 2, or by way of raising the water pressure by the pump 6, or by way of variation of the nozzle diameter.

Figure 3:
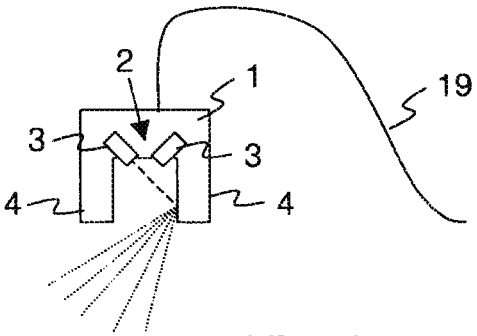
FIG. 3 one design of a protective body.

FIG. 3 shows one design of a protective body 4. A fluid jet which does not hit another fluid jet, or does this only in an inadequate manner, may be captured by the protective body 4. This may particularly be the case if a nozzle is blocked or damaged. One prevents the jet from directly impacting the skin or the eyes by way of the protective body 4. The protective bodies or suitable formations of the outlet 1 are also arranged in a manner such that they in each case lie in the jet direction of the individual nozzles 3, but with a functionally correct operation of the outlet 1 are not essentially hit by the atomised fluid, thus are essentially of no hindrance to the sprayed fluid.

Figure 4:
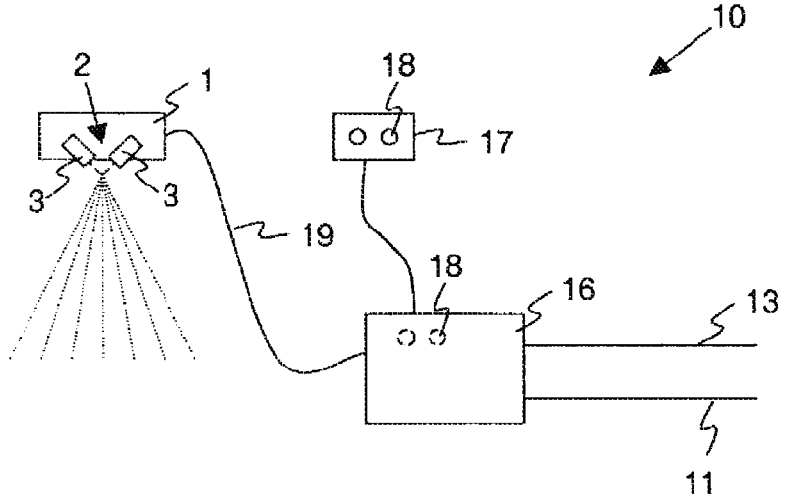
FIG. 4 a construction unit of a washing device.

FIG. 4 shows a construction unit 16 of a washing device. Depending on the embodiment, the previously presented elements, such as in particular the heater 5, the pump 6, the micro-filter 7, and, as the case may be, also the mixing device 14 and the soap feed 15 etc., are grouped together in a compact unit in a housing, in the construction unit 16. The housing comprises an energy supply 13 and a cold water supply 11, and feeds the outlet 1 via the hose 19. Optionally, operating elements 18 for the control or regulation (closed loop control) of the temperature or pressure may be arranged on a recessed operating unit 17. In another variant (drawn in a dashed manner), the operating elements 18 are arranged on the construction unit 16 itself.

In another preferred embodiment of the invention, the construction unit 16 has the same elements with the exception of the pump 6, and is connected to an external pump for increasing the pressure. The external pump may supply several such construction units 16. A washing device system according to this embodiment, thus, comprises at least one construction unit 16 and an external pump and a pressurised water conduit for feeding the at least one construction unit 16 by the pump 6.

Preferably, the pump 6 and the heater 5, activated by the operating unit, are switched on for operating the washing device for dispensing heated water. Warm water may be taken in a quasi direct manner, thus without any significant heating-up time, since the heater 5 preferably has no storage means. As the case may be, for this, the pump may be switched on with a small delay of a few seconds, i.e. less than 2 or 5 or 10 seconds. Alternatively, the pump 6 in this time may be controlled from standstill, and be gradually run up to the normal delivery power, so that the dispensing temperature may be increased already from the beginning.

In another preferred embodiment of the invention, the switching-on and switching-off of the washing device is controlled by an electrical switch or sensor at the outlet 1. Alternatively, a mechanical valve is arranged on the outlet 1 or in the feed conduit 19. When the user opens the valve, a pressure change in the feed conduit 19 takes place, which is detected by a sensor in the construction unit 16, whereupon the washing device, with pump and, as the case may be, also the heater 5, is switched on by way of the control of the construction unit 16.

Figure 5:
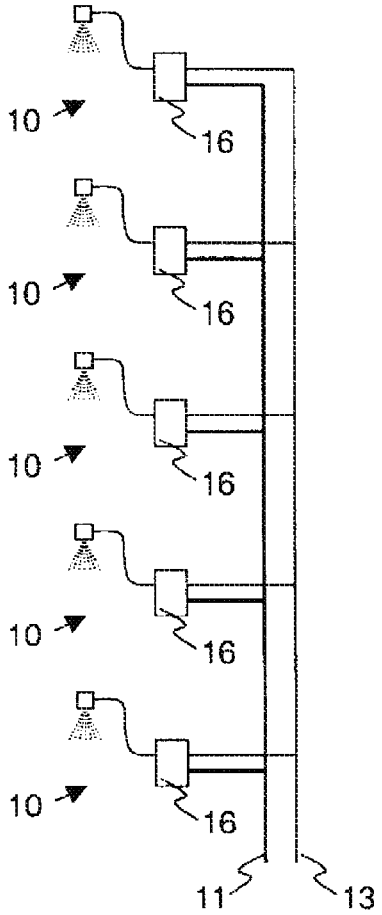
FIG. 5 an installation with several washing devices.

FIG. 5 shows an installation with several washing devices 10. Only one cold water supply 11 and the energy supply 13 is present at each of the washing devices 10. The washing devices 10 are for example arranged at several locations of a building or a mobile washing installation.

Figure 6:
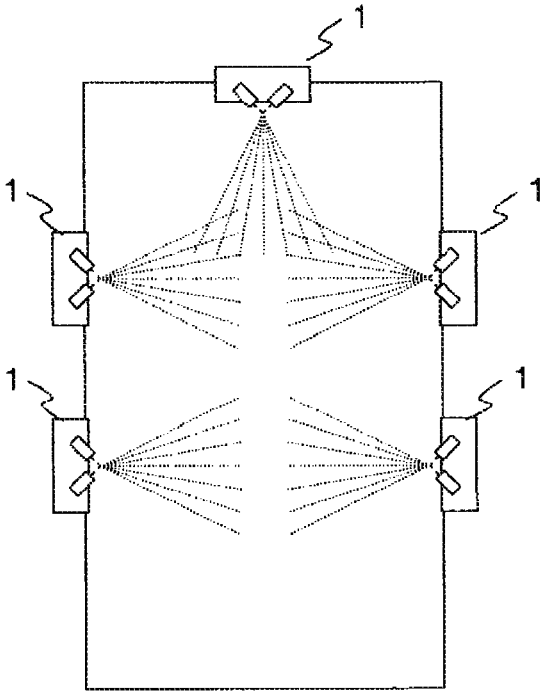
FIG. 6 a washing installation or shower cubicle.

FIG. 6 shows a washing installation or shower cubicle. Several outlets 1 which are preferably supplied with heated pressurised water via a common supply unit 16, are arranged in this above and laterally of the washing space. It has been found that a very good homogenous heat distribution and a pleasant shower sensation arise by way of this. The same effect arises also with only one nozzle head when the shower cubicle remains closed. The thermal transmission to body is very good despite the small quantity of water which is used. The small drops very quickly heat the room air, which provides a homogeneous sensation of warmth. The homogeneous heat distribution is due to the fact that the air is very quickly warmed by way of the large surface area of the droplets. The droplets cool immediately on account of their low mass. A temperature equilibrium occurs very quickly.

Figure 7:
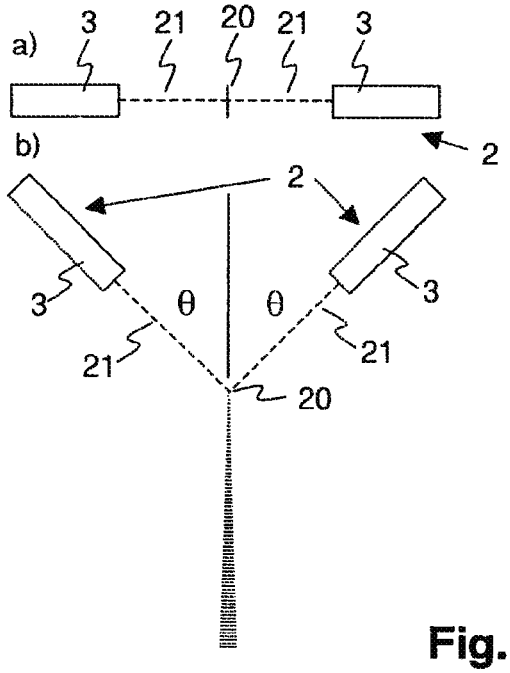
FIG. 7 an arrangement of two nozzles in a plan view a) and in a lateral view b)

FIG. 7 schematically shows an arrangement of two nozzles 3 in a plan view a), seen in the direction of a main spray direction of the device, and in a lateral view b). The jets 21 of the liquid which are aligned onto one another meet in a impact point or collision point 20. The two jets 21 define a first plane. The water droplets which are sprayed by the impact form a spray body which is symmetrical to a further plane, wherein the second plane is essentially perpendicular to the first plane. An angle θ between the jets 21 and a bisecting line of an angle are drawn in the lateral view.

Figure 8:
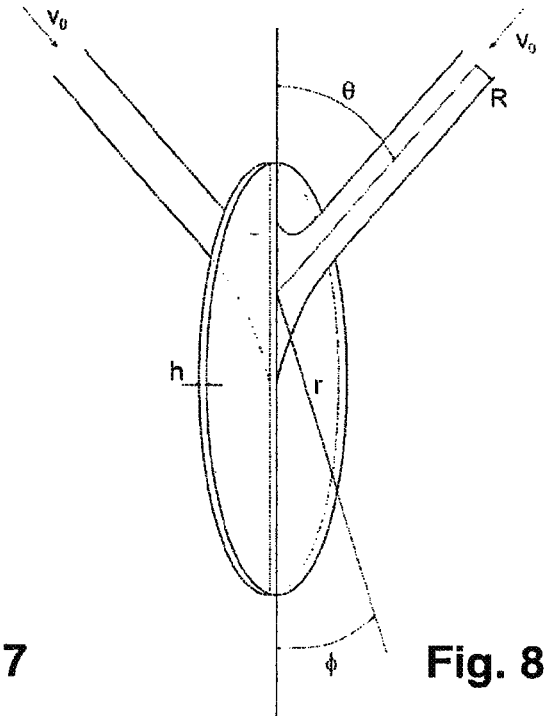
FIG. 8 a structure of a water disk, as arises with impacting water jets.

FIG. 8 shows the structure of a water disk, as arises with impacting water jets. As in FIG. 7, the main spray direction also runs downwards in FIG. 8. The shown parameters: $v_o$; jet speed; r: distance of the impact point to the disk edge; 2θ: impact angle; h: thickness of the disk; 2R; jet diameter; ϕ: angular position.

If two equally strong water jets are directed against one another, then a thin water disk is formed between them. The disk disintegrates at a certain distance from the point of impact of the two jets, and produces fine drops by way of this.

If the two water jets are equally strong, then the vertical components of their impulses neutralise on impact, and a thin water layer propagates horizontally by way of the pressure which has arisen at the moment of impact. The disk is destroyed as soon as holes arise, which increase further in size on account of the surface tension of the water.

The nozzles and, thus, the produced fluid jets as a rule are round, but may also have a rectangular cross section or generally have a prismatic shape.

Calcifications in the nozzles are not formed at all or are then eroded again by way of (for the sanitary field) high operating pressures and the low water temperatures.

Figure 9:
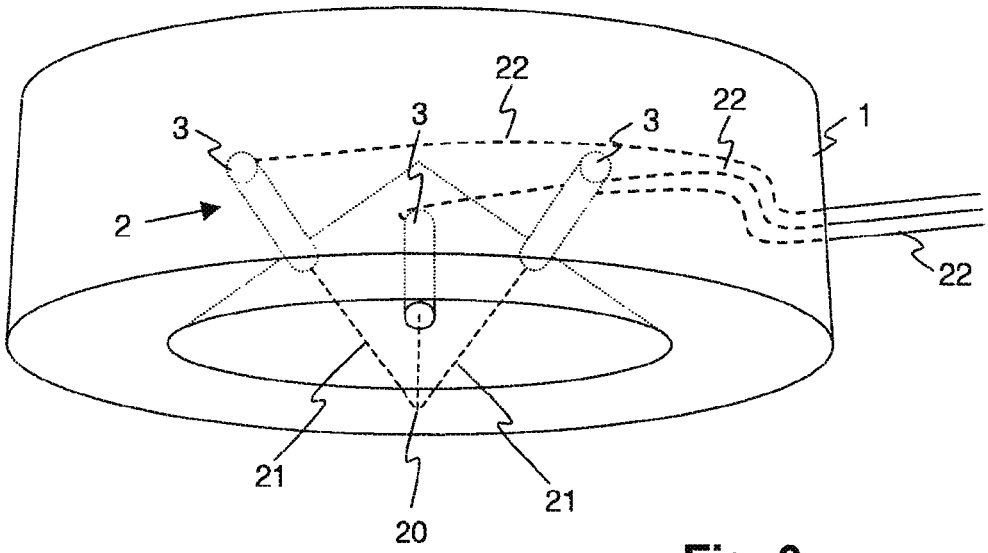
FIG. 9 a perspective view of a nozzle set with three nozzles.

FIG. 9 schematically shows a perspective view of a nozzle set 2 with three nozzles 3. Water disks, whose planes, seen from above and with equally strong jets, lie in the angle bisecting line between the jets, arise at the impact point. In an analogous manner, more than 3 nozzles 3 may also be arranged essentially on a circle and be directed onto the point of impact. Half the impact angle ϕ lies in each case between the jets and the perpendicular axis of symmetry of the nozzle set 2. Each of the nozzles 3 is supplied with fluid via a nozzle supply conduit 22 by way of the common pump 6. The nozzle supply conduits 22 are only drawn in schematically in the figure, but in reality they are formed e.g. by way of cavities between the individual parts of the outlet 1. In another preferred embodiment of the invention, different nozzles 2 are supplied with different liquids, thus given three nozzles with two or three different liquids. Such different fluids may for example be soaps, soap solutions, disinfectants, etc.

In another preferred embodiment of the invention, the outlet 1 comprises several nozzle sets which are arranged next to one another in a row or are arranged on a circular arc or circle.

Figure 10:
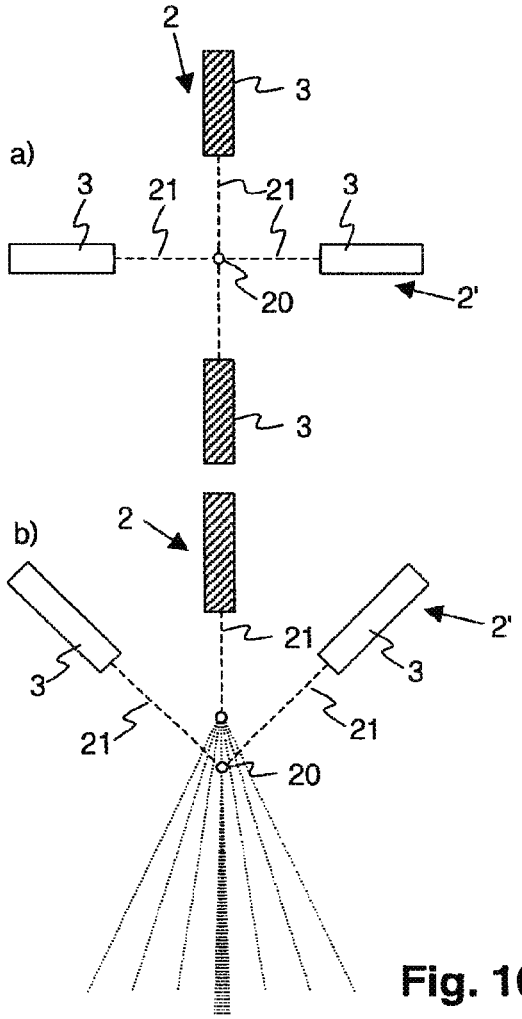
FIG. 10 an arrangement of two nozzle pairs in a plan view a) and in a lateral view b)

In a further embodiment of the invention, the outlet 1 comprises at least two nozzle sets, wherein the nozzles 3 are arranged at least approximately in a plane, and the impact points of the two nozzle sets 2 are distanced to one another in a direction which runs at least approximately perpendicular to this plane. FIG. 10 schematically shows such an arrangement in a plan view a) and a lateral view b): Two nozzle sets 2, 2' are arranged transversely to one another: The jets 21 of each nozzle set 2, 2' define a plane of the nozzle set 2, 2". The planes of the two nozzle sets 2, 2' are at an angle to one another, and in the shown example are at least approximately at right angles. The impact points of the two nozzle sets 2, 2' are preferably distanced to one another, but both lie on the intersection line of the two planes.

Figure 11:
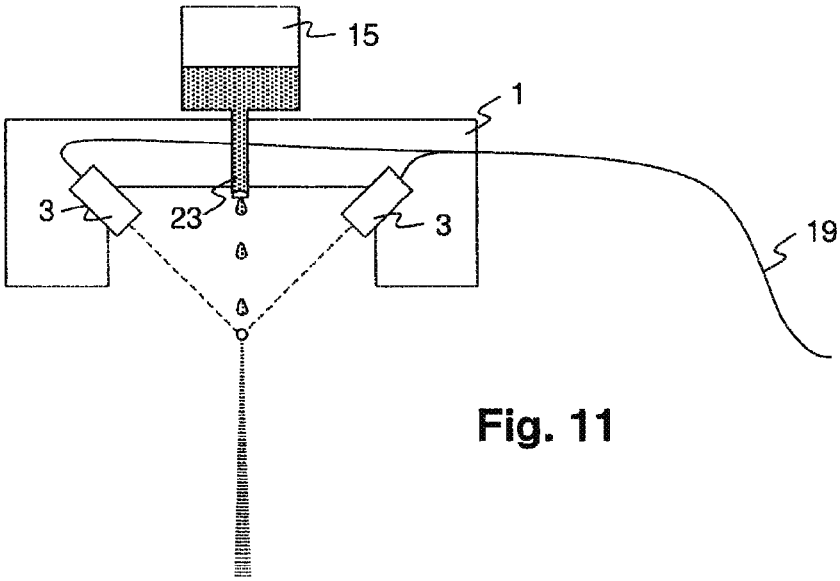
FIG. 11 an outlet with a soap feed.

FIG. 11 shows an outlet 1 with a soap feed 23. The soap feed 23 is arranged in the outlet 1 above the impact point 20, so that the fed soap drops or runs into the region of the impact point 20. The soap is entrained and mixed by way of the water jets which impact one another. The soap feed 23 is preferably controllable or may be switched on and off. For this, it comprises, for example, a control means, for example a closure or a valve or a pump which is controllable, which means may be switched on and off via control lead or by hand. In a preferred embodiment of the invention, the soap feed, as a metering means, comprises an intermediate storage means. The intermediate storage means is filled with a certain quantity of soap on actuation of the control means, and subsequently dispenses this again successively to the fed water, as in FIG. 11, to the impact point 20, until it is empty.

The soap may be fluid or powder-like, and may be led with the soap feed 23 closer to the impact point 23 than is indicated in the figure. In this manner, other fluids or powder-like additives may also be admixed instead of soap. Also gaseous additives may be supplied or blown with its own nozzle as a gas jet onto the impact point 23 in a directed manner.

Figure 12:
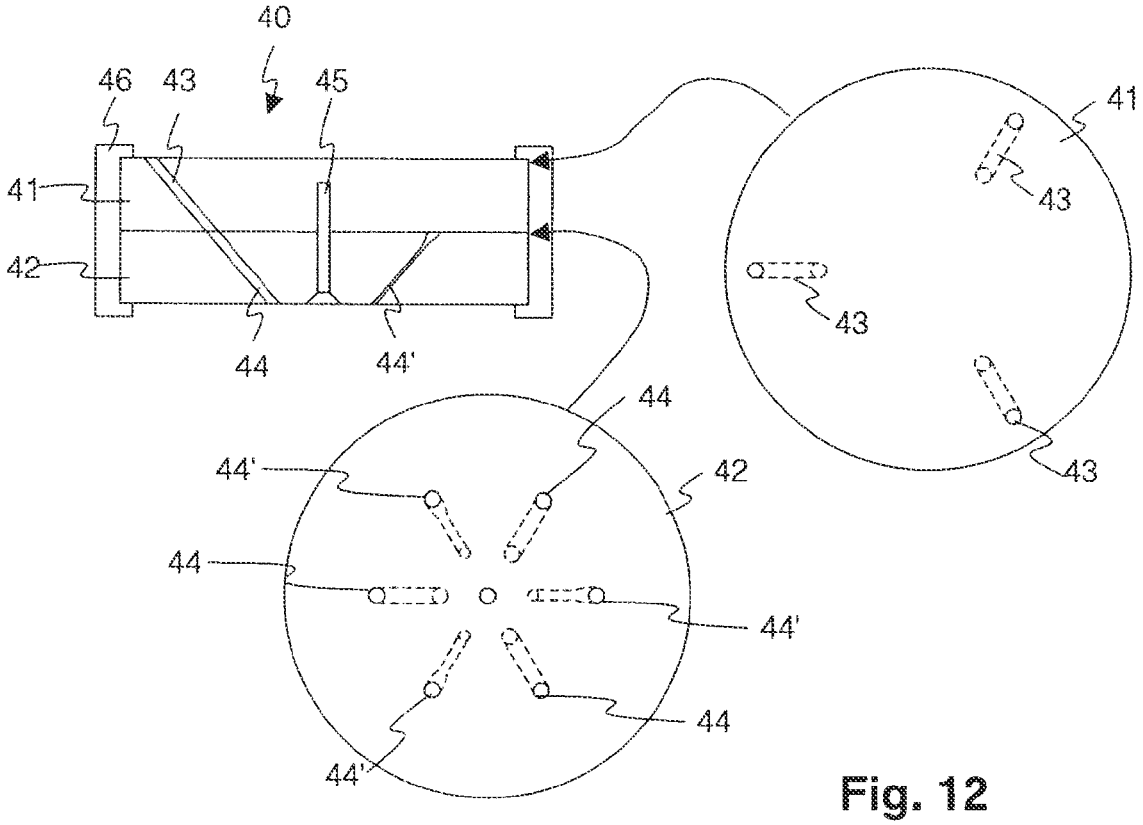
FIG. 12 a nozzle body with two nozzle disks which may be rotated to one another.

FIG. 12 shows a nozzle body 40 as part of an outlet 1. The nozzles are formed by bores in a nozzle body. Three nozzles are shown by way of example, but combinations of two, four or more nozzles may be realised in the same manner. In the simplest case, the nozzle body 40 is of one piece. In the embodiment of FIG. 12, the nozzle body comprises an upper nozzle disk 41 and a lower nozzle disk 42 which are arranged rotatable to one another. The two nozzle disks 41, 42 are pressed against one another, for example, by way of a central screw 45 and/or by way of a flange ring 46. The fastening on the outlet 1 may likewise be effected with a central screw 45 and/or the flange ring 46. FIG. 12 shows the nozzle body 40 in cross section and the two nozzle disks 41, 42 separately, in each case in a plan view.

The nozzle body 40 is arranged in the outlet 1, such that the upper nozzle disk 41 is impinged with the fluid under pressure, and the lower nozzle disk 42 faces the spray direction. The upper nozzle disk 41 comprises a set of upper bores 43, and the lower nozzle disk 42 at least two sets of lower bores 44. The position of the upper bores 43 may be selectively brought to correspond with the position of one of the sets of the lower bores 44 by way of rotating the nozzle disks to one another. Thus different sets of lower bores 44 are in operation in a selective manner. These are preferably designed in a different manner, so that different spray characteristics result, depending on the selection of the lower set of bores. This different design may, for example, relate to the diameter of the nozzles or their mutual alignment.

In another preferred embodiment of the invention, the upper nozzle disk 41 comprises several sets of upper bores 43, which in each case are fed with different fluids or fluid combinations. The lower nozzle disk 42 in this embodiment only comprises one set of lower bores 44, and may be connected in each case to one of the sets of the upper bores 43 by way of rotation, so that a different composition of the sprayed fluid results, depending on the selection of the upper set of bores.

Figure 13:
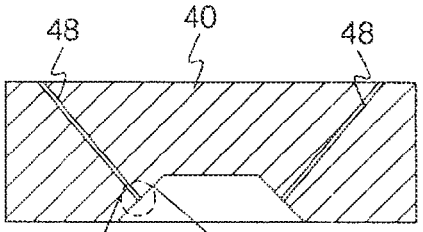
FIG. 13 a single-piece nozzle body.

FIG. 13 shows a single-piece nozzle body 40 or a lower nozzle disk 42, in cross section, as well as details of the nozzle openings. The nozzle body 40 or the nozzle disk 42 is preferably manufactured of metal or a technical plastic, for example by way of injection molding, wherein the nozzle channels 48 are preferably formed by way of moving slides. The plastic, for example, is polyoxymethylene (POM) or polyamide (PA) or polyphenylene sulphide (PPS) and may be provided with inclusions of other materials.

Figure 14:
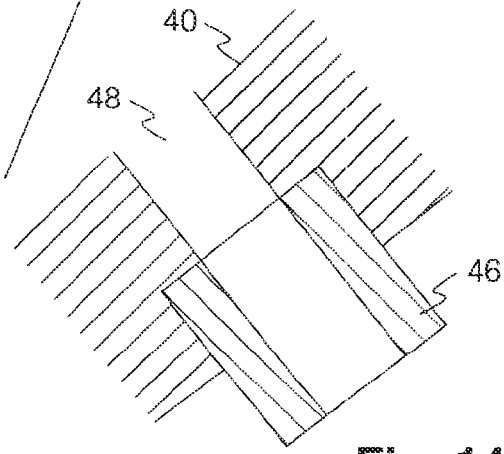
FIGS. 14 and 15 detailed view of nozzle openings.

FIG. 14 shows a detailed view of a cross section through a first embodiment for the design of the nozzle openings, preferably whilst using a two-component injection molding method. One nozzle opening at the outer end of a nozzle channel 48 is formed by a projecting tube piece 46 of a softer plastic, which is peripherally injected by the harder technical plastic of the nozzle body 40 or of the nozzle disk 42. The softer plastic may be deformed by, so that furring breaks away.

Figure 15:
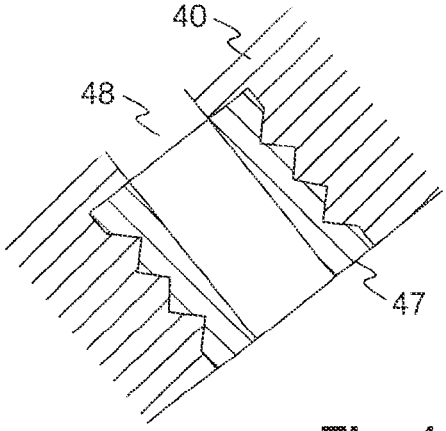

FIG. 15 shows a detailed view of a cross section through a second embodiment for the design of the nozzle openings. A nozzle opening at the outer end of a nozzle channel 48 is formed by a pipe piece 47 of metal, for example chrome steel, which is peripherally injected by the technical plastic of the nozzle body 40 or the nozzle disk 42. With this, the exit openings of the nozzles may be formed with greater precision than would be possible with the manufacture solely of plastic.

One the one hand the nozzles are adequately long and comprise a smooth inner surface, by which means a laminar flow is achieved, for achieving a precise jet. Preferably, the nozzles are at least double the length of their diameter. On the other hand, the reflection edges at the end of the nozzle inner side are shaped in a suitable manner, preferably by way of them forming a right angle. This is preferably the case for all embodiments of the invention.

Figure 16:
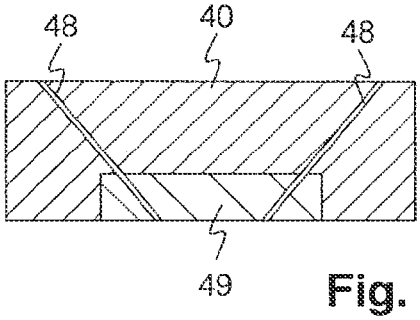
FIG. 16 a two-part nozzle body.

The tube pieces may be formed on a single piece of metal and be peripherally injected together, as is shown in FIG. 16, for achieving a high precision. In particular, the nozzle channels 48 may be formed in a disk-like insert or differently shaped insert 49. The insert 49 is peripherally injected with the plastic, for forming the nozzle body 40 or the nozzle disk 42, wherein the plastic has a continuation of the nozzle channels 48.

Figure 17:
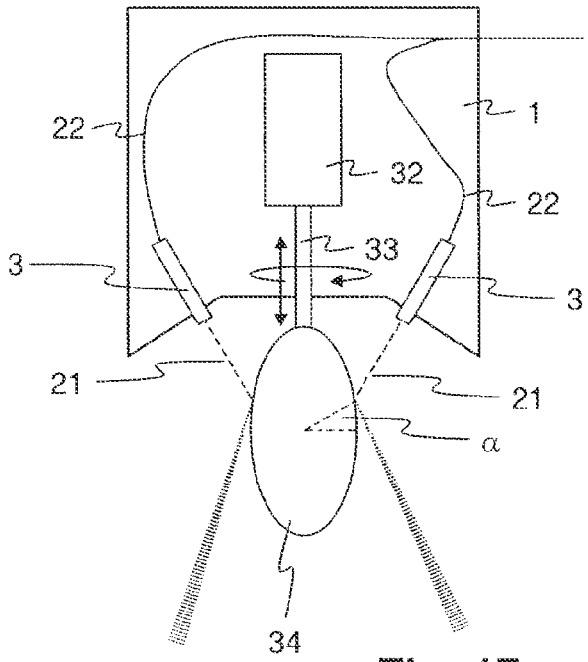
FIG. 17 an outlet with an atomisation body.

FIG. 17 shows an outlet 1 with an atomisation body 34. The atomisation body 34 is linearly displaceable in the direction of an axis 33 and/or arranged in a rotatable manner about this axis 33. A drive unit 32 effects this movement or movements, and for this comprises one or two individual drives or motors. At least one nozzle 3 is directed onto the atomisation body 34, so that the fluid jet of this nozzle 3 impinges the atomisation body 34 on operation of the washing device 10. With a linearly displaceable atomisation body 34, the jet hits a differently oriented surface and/or a differently structured surface, according to the position of the atomisation body 34. For example, with the atomisation body 34 of FIG. 18, which for example is an ellipsoid of revolution, a jet hits a sector of the surface at a height angle $\alpha$ with respect to the equator of the ellipsoid. Thus, the impact angle of the jet onto the atomisation body 34 and the average direction of the atomised jet vary in dependence on the height angle $\alpha$.

Figure 18:
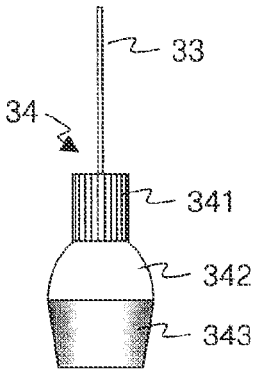
FIGS. 18 to 20 further atomisation bodies.

In a preferred embodiment of the invention, the atomisation body 34 has different surface structures along the displacement axis, so that different atomisation characteristics may be achieved by way of displacing the atomisation body 34. For example, with the atomisation body 34 of FIG. 17, the surface for different regions of height angles $\alpha$ may in each case have different roughnesses. FIG. 18 shows an atomisation body 34 with this characteristic, but without it having an ellipsoid as a basic shape. The atomisation body 34 is essentially rotationally symmetrical and/or prismatic with respect to the axis or rotation axis 33. For example, along the rotation axis 33, it comprises a first sector 341 with a toothed surface, a second sector 342 with a smooth surface and a third sector 343 with a roughened surface, similar to sandpaper. By way of displacing the atomisation body 34, the jet is atomised on the one or other sector 341, 342, 343 with completely different characteristics. In the shown embodiment, therefore each of the sectors has a different surface structure and one or more different orientations of the surface with respect to a jet.

Figure 19:
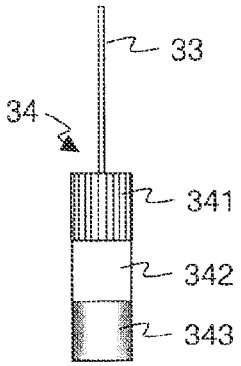

In another embodiment according to FIG. 19, the atomisation body 34 is a rotation cylinder, thus has different surface structures with a constant impact angle and reflection angle with a displacement along the axis 33. Such an embodiment may be applied in a rotating or non-rotating manner, wherein in both cases the different surfaces of the sectors 341, 342, 343 may be applied by way of displacement along the axis 33.

Such an atomisation body 34 may be applied with different operating modes, wherein certain embodiments for the invention may also be directed only to individual ones of these operating modes. In a first operating mode, the water jets or fluid jets 21 in the nozzles 3 are produced with a high pressure, and the linear displacement ability of the atomisation body 34 is used in order to obtain different or dynamically variable atomisation bodies. For this, it is not absolutely necessary for the atomisation body 34 to also be rotatable or to be rotated. The energy for atomisation originates from the high speed of the jets. By way of moving the atomisation body 34, be it by way of rotation and/or displacement, differently structured surface regions may be brought into the region of the jet 21.

In a second operating mode, the atomisation body 34 is rotatable with a high speed about the rotation axis 33. The energy for atomisation originates from the rotation of the atomisation body 34, so that the nozzles may be operated at high pressure but also at low pressure, which means that they may be operated without a pump 6. Thereby, the atomisation body 34 may also be displaceable as in the first operating mode, but it may also be non-displaceable.

Figure 20:
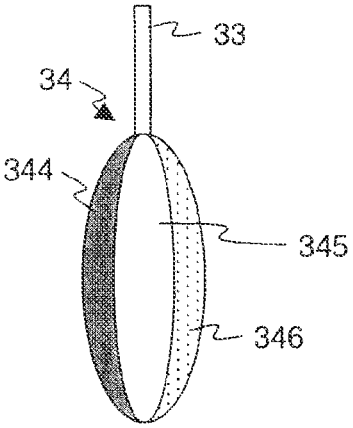

FIG. 20 shows an atomisation body 34 in the form of an ellipsoid of revolution, with further sectors 344, 345, 346 with different surface structures. On rotating the atomisation body 34 about the rotation axis 33, different sectors 344, 345, 346 are hit by the jet 21. The impact angle and the reflection angle are changed by way of displacement along the rotation axis 33. This displacement body 34 is thus not envisaged for a rapid rotation for atomisation. The further sectors 344, 345, 346 correspond to different "degrees of longitude" whilst the sectors 341, 342, 342 of FIGS. 18 and 19 correspond to different "degrees of latitude" or height angles $\alpha$.

Figure 21:
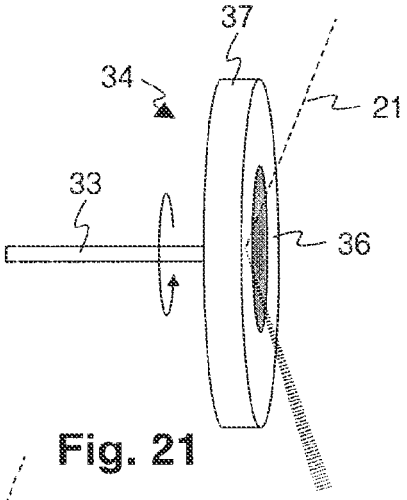
FIGS. 21 and 22 a disk as an atomisation body.
Figure 22:
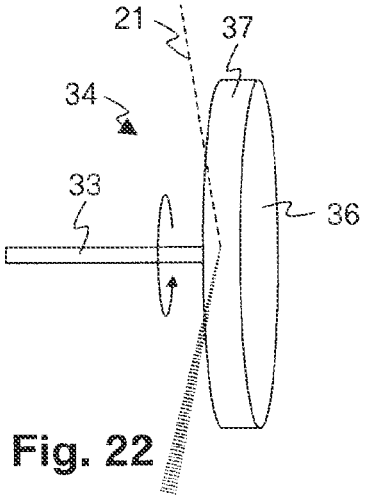

FIGS. 21 and 22 show a disk as an atomisation body. Here at least one nozzle 3 is directed onto a disk surface 36 or onto the disk edge 37. The disk surface 36 may have different surface structures depending on the radius, which is indicated in FIG. 21 by a shaded region. The disk surface 36 may also be profiled, which means that the disk surface 36 is not plane, but has a rotationally symmetrical profile as a function of the radius. With this, different impact angles and reflection characteristics may be achieved by way of displacing the nozzle 3 along the radius.

Figure 23:
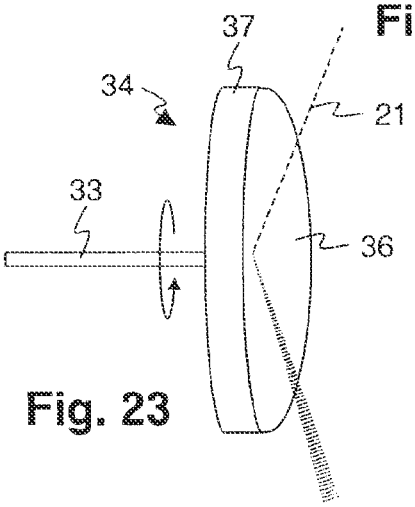
FIG. 23 an arcuate disk as an atomisation body.

The disk surface 36, in a different embodiment of the invention, is curved according to FIG. 23, for example in the form of a spherical surface, so that the reflection angle is also dependent on the radius of the impact point.

Suitable rotational speeds for rotating atomisation bodies 34 range from 5,000 to 200,000 rpm. The average droplet size in the atomised jet is varied by way of varying the rotational speed, wherein the droplet size is dependent on the relative speed between the jet and the atomisation body 34. It has been shown that a droplet size of about 20 to 80 micrometers requires a relative speed of about 50 m/s This for example means that for this, with a stationary atomisation body 34, the jet must have a speed of about 50 m/s. Vice versa, if the jet has a speed of only a few m/s, then the atomisation body 34 must move at this speed at the impact point. This for example means that a surface point of a disk or a cylinder with a diameter of 30 mm must rotate at approx. 30,000 rpm.

Figure 24:
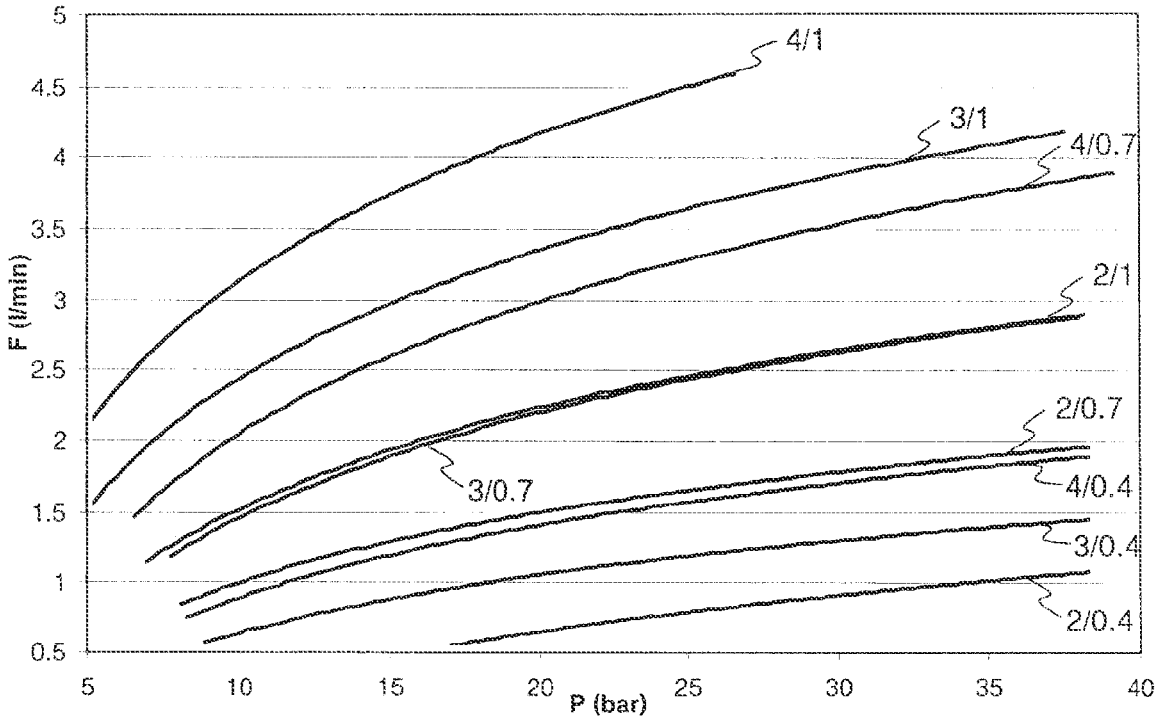
FIG. 24 pressure relations and throughput relations with various nozzle types.

FIG. 24 shows pressures and throughput rates F for various nozzle diameters and nozzle numbers. With each curve, the respective value X/Y represents a nozzle number X and a nozzle diameter Y in millimeters, thus for example 2/0.7 represents an arrangement with 2 nozzles of 0.7 mm diameter.

In a preferred embodiment of the invention, the maximal throughput quantity of the outlet is 3 l/min and preferably 1.5 to 2 l/min, which corresponds to a heating device with a heating power of about 3 kW. Preferably, 3 nozzles with a diameter of 0.4 mm are operated at a pressure of 20 bar. Half the impact angle $\phi$ is preferably 45°. Most, thus about 80% or more of the produced droplets thereby preferably have a diameter of below 100 micrometers.

Figure 25:
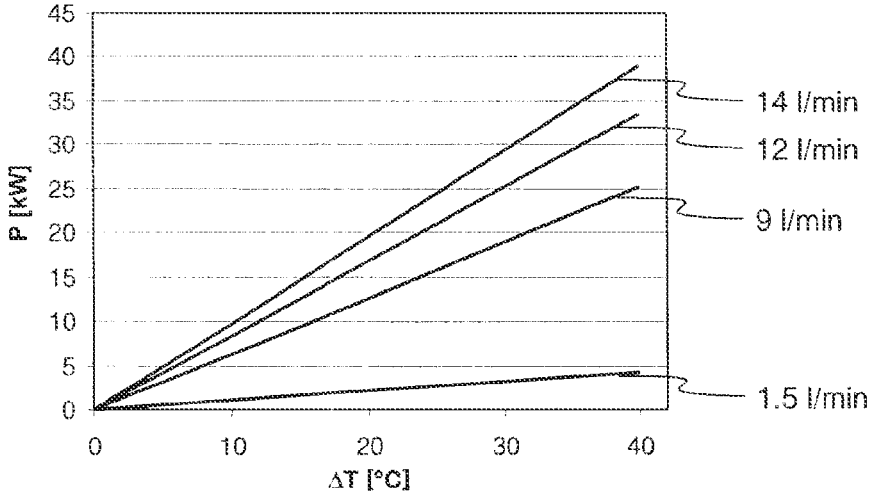
FIG. 25 heat power requirement with different water throughputs.

FIG. 25 shows a heating power requirement P in kW for different water throughput quantities in liters per minute in dependency on the produced temperature difference ΔT. A throughput quantity of 14 l/min corresponds to a normal shower, 12 l/min corresponds to an adjustable shower, 9 l/min to an economy shower and 1.5 l/min corresponds to one embodiment of the invention. A continuous power of 25 kW is required in order for example to heat the continuously running water to a temperature difference of 30° at 12 liters/minute. Thereby, an optimal efficiency of the heating is assumed. With a throughput quantity of 1.5 l/min only about 2 kW is required.

Figure 26:
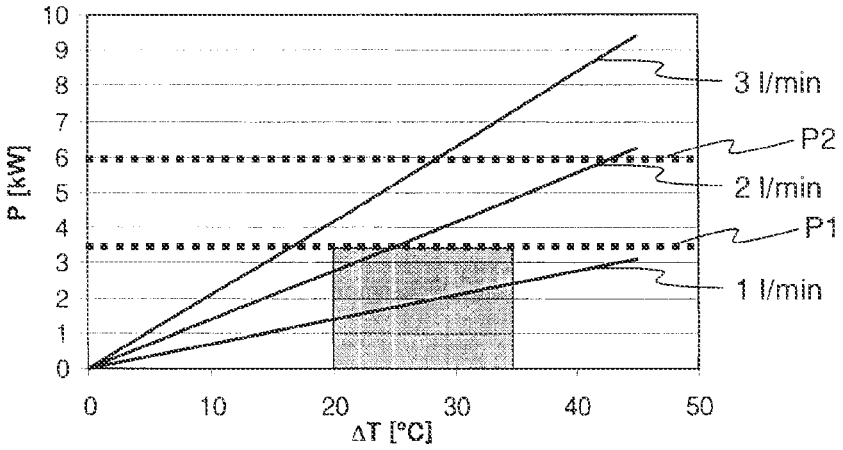
FIG. 26 heat power requirement in relation to the heating power.

This lies within the framework of a heater 5 which may be supplied by a common house installation with 230V alternating current or 400V three-phase current. FIG. 26 shows a heating element for low throughput quantities of 1.2 and 3 l/min, as may be realised according to the invention. For this, maximal realisable values for heating powers are drawn in: a lower horizontal line at a first heating power of approx. 3.6 kW and a higher upper horizontal line at a second heating power of appear. 6 kW. This corresponds to a supply at 230 or 400 Volts at 16 Amps.

The shower water must be heated to about 20 to 35 degrees depending on the season and the desired water temperature. This corresponds to the shaded region in the representation. In this region, thus an electrical instantaneous (tankless) heating may be used for throughput quantities between 1 and 2 liters. A storage heater or boiler or a more powerful heater is required for greater throughput quantities.

LIST OF REFERENCE NUMERALS

1 outlet
2, 2' nozzle set
3 nozzle
4 protective body
5 heater
6 pump
7 micro filter
8 mixing tap
10 washing device
11 cold water supply
12 warm water supply
13 energy supply
14 mixing device
15 soap feed
16 construction unit
17 operating unit
18 operating elements
19 hose, feed conduit
20 impact point and water disk
21 fluid jet
22 nozzle supply conduit
23 soap feed
32 drive
33 rotation axis
34 atomisation body
341-346 sectors of the atomisation body
35 atomisation disk
36 disk surface
37 disk edge

What is claimed is:

1. A washing device for dispensing water or a water-based mixture in a shower or a sink, comprising at least one outlet for spraying fluids at a low throughput rate and under increased pressure, and at least one delivery device for increasing a fluid pressure before the spraying, to an operating pressure of the outlet;

comprising a mixing device for mixing fluids, said fluids comprising water with disinfectant or with soap, before the dispensing;

wherein the washing device can be operated in a first and a second operating mode, wherein in the first operating mode a further fluid is admixed to the water, preferably a disinfectant or soap, and in the second operating mode no further fluid is admixed to the water, and the water throughput in the second operating mode compared to the first operating mode is higher; and, wherein the water throughput in the first operating mode is less than 0.5 l/min, and the water throughput in the second operating mode is greater than 1 l/min.

2. The washing device according to claim 1, wherein nozzles are provided each with different fluids or fluid mixtures.

3. The washing device according to claim 1, comprising at least one nozzle set of at least two nozzles for producing impacting fluid jets and for atomising the fluid or fluids.

4. The washing device according to claim 3, wherein for each of different fluids at least a pair of nozzles producing impacting fluid jets is provided.

5. The washing device according to claim 4, wherein impact points of two or more pairs of nozzles, according to the different fluids, are arranged at a distance from each other.

6. The washing device according to claim 2, comprising a rotatable nozzle disk for the selection of one of the different nozzle sets and thereby the mixture of the atomised fluid.

7. The washing device according to claim 1, wherein a change from one throughput rate to another, according to the first and the second operating mode, is effected by increasing or decreasing the water pressure via the delivery device.

8. The washing device according to claim 1, wherein the change from one throughput rate to another, according to the first and the second operating mode, is effected by switching between the nozzle sets.

9. The washing device according to claim 1, wherein the mixing device is arranged near the outlet and is not separated from the outlet by means of a hose or outlet conduit.

10. The washing device according to claim 2, wherein the mixing device admixes the further fluid to the fluid supply of at least one but not of all nozzles.

11. The washing device according to claim 3, wherein a feed for feeding a further fluid is arranged to feed the further fluid to the region of the impact point of the fluid jets.

12. A washing device for dispensing water or a water-based mixture in a shower or a sink, comprising at least one outlet for spraying fluids at a low throughput rate and under increased pressure, and at least one delivery device for increasing a fluid pressure before the spraying, to an operating pressure of the outlet;

comprising a mixing device for mixing fluids, said fluids comprising water with disinfectant or with soap, before the dispensing;

wherein the outlet is part of a shower head, and the maximal throughput quantity of the outlet is between about 1 l/min to 2 l/min, or wherein the outlet is part of a water tap, and the maximal throughput quantity of the outlet is 0.5 l/min.

13. The washing device according to claim 1, wherein the delivery device for delivering the water or the fluid at a pressure of 15 bar to 25 bar is provided.

14. The washing device according to claim 2, wherein the nozzles have a diameter of between 0.4 mm and 0.7 mm.

15. A method for operating a washing device for dispensing water or a water based mixture through a shower head or a water tap, comprising the following steps:

providing a mixing device for mixing fluids, said fluids comprising water with disinfectant or with soap, before dispensing;

operating the washing device in one of a first and a second operating mode, wherein in the first operating mode a further fluid is admixed to the water, preferably a disinfectant or soap, and in the second operating mode no further fluid is admixed to the water, and the water throughput in the second operating mode compared to the first operating mode is higher;

wherein the water throughput in the first operating mode is less than 0.5 l/min, and the water throughput in the second operating mode is greater than 1 l/min and increasing a water pressure or fluid pressure to an operating pressure of an outlet;

spraying the water or the fluid by way of the outlet at an increased pressure and with a low throughput rate; and, mixing of a further fluid with the water or the water-based mixture before the dispensing.

16. The method according to claim 15, further comprising the step of heating the water to a set temperature via an electrical tankless heater.

* * * * *